US008512041B2

(12) United States Patent
Reardon et al.

(10) Patent No.: US 8,512,041 B2
(45) Date of Patent: Aug. 20, 2013

(54) COMBAT SIMULATION AT CLOSE RANGE AND LONG RANGE

(75) Inventors: Peter F. Reardon, Orlando, FL (US); Steven Preston, Winter Springs, FL (US); Charles T. Penrose, Oakland, FL (US)

(73) Assignee: Lockheed Martin Corporation, Orlando, FL (US)

( * ) Notice: Subject to any disclaimer, the term of this patent is extended or adjusted under 35 U.S.C. 154(b) by 294 days.

(21) Appl. No.: 12/913,480

(22) Filed: Oct. 27, 2010

(65) Prior Publication Data

US 2012/0231423 A1 Sep. 13, 2012

(51) Int. Cl.
*F41G 3/26* (2006.01)

(52) U.S. Cl.
USPC ..... 434/22; 434/19; 434/11

(58) Field of Classification Search
USPC ..... 434/11–27; 372/9–33; 463/49–57
See application file for complete search history.

(56) References Cited

U.S. PATENT DOCUMENTS 3,877,157 A * 4/1975 Ashford et al. ..... 434/22
4,315,689 A 2/1982 Goda
5,788,500 A * 8/1998 Gerber ..... 434/22
6,315,568 B1 * 11/2001 Hull et al. ..... 434/22
6,549,872 B2 4/2003 Bollweg et al.
6,863,532 B1 3/2005 Ambrosoli
6,914,731 B2 7/2005 Fredriksson
2005/0147945 A1 7/2005 Lampl

OTHER PUBLICATIONS

Mi, L., et al., "Shaping Semiconductor Laser Beam with One-Dimension Gradient-Index Lens", Journal of Physics Conference Series 46 (2006) pp. 785-789, International Symposium on Instrumentation Science and Technology, 2006 IOP Publishing Ltd.

* cited by examiner

*Primary Examiner* — Timothy A Musselman
(74) *Attorney, Agent, or Firm* — Jetter & Associates, P.A.

(57) ABSTRACT

A simulated weapon for simulating projectiles fired at a target includes a firearm housing and an optical transmitter. The firearm housing is configured to be aimed at the target by a gunner. The optical transmitter is mechanically coupled to the firearm housing and is configured to transmit an optical beam that simulates a projectile. The optical transmitter includes an optical generator for generating the optical beam and a beam shaping element operatively positioned to receive the optical beam from the optical generator. The beam shaping element is configured to adjust an intensity profile of the optical beam that is incident upon the target so that a first portion of the optical beam simulates a trajectory of a projectile and a second portion of the optical beam has a greater divergence than the first portion of the optical beam.

20 Claims, 11 Drawing Sheets

COMBAT SIMULATION AT CLOSE RANGE AND LONG RANGE

BACKGROUND

Civilian and military firearm shooting training is important for a variety of reasons such as teaching initial weapon handling skills. Improving the quality and amount of training for weapon delivery is a critical component in force readiness. It is important to assess performance measures such as reaction time, weapon tracking, and target identification skills. The ever increasing threat of close quarter conflict by both terrorist and militant groups has increased the demand for direct-fire weapons training more than ever. Live-fire training ranges are insufficient, and training ammunition is expensive and dangerous. Simulation provides a cost effective means of teaching initial weapon handling skills, particularly in areas that live fire cannot address due to safety or other restrictions.

One type of system that is employed for combat simulation consists of laser or other optical transmitters mounted on fire arms, which trigger light detectors on potential targets. The detectors triggered by the laser show the effects of a projectile from the respective fire arm. In this way it is possible to quickly and automatically detect where a fired shot has hit. A number of problems arise when such systems are used to simulate close weapon firing.

This Background is provided to introduce a brief context for the Summary and Detailed Description that follow. This Background is not intended to be an aid in determining the scope of the claimed subject matter nor be viewed as limiting the claimed subject matter to implementations that solve any or all of the disadvantages or problems presented above.

SUMMARY

One particular problem that arises when a laser-equipped weapon is used for combat simulation is that it can be difficult to use the same laser transmitter to simulate both close combat and long-range combat. This is because the laser or other optical beam that is used diverges as it travels greater and greater distances. Thus, a laser beam incident upon a target at close range will have a smaller beam size than the same laser beam when it is incident upon a target at a more distantly located. In both cases the divergence characteristics of the beam make it difficult to simulate the firing of a weapon. In the close combat case, the beam size may be too small when it hits the target. As a result, the optical beam may hit the target yet fail to hit the detector located on the target. In the long range combat case, the relatively large beam size of the optical beam when it is incident upon the target can make it too easy to hit the target, thus not offering a realistic simulation experience.

These and other problems are addressed by arranging a weapon equipped with an optical transmitter so that it can optically process the beam to adjust or control its beam shape and size. In one illustrative example, the optical beam that is produced has two portions or components: one portion with a relatively large divergence, which is useful when the target is at close range, and the another portion with a smaller divergence, which is useful when the target is more distantly located. In this way the weapon can more accurately simulate both close combat and long distance combat.

The optical transmitter located on the weapon may include a beam shaping element to optically process the beam in the manner described above. Illustrative examples of beam shaping elements that may be used include a wide variety of optical elements such as lens, mirrors and/or diffractive optical elements. Such beam shaping elements can be used to adjust the intensity profile of the optical beam so that it has both a large divergence portion and a small divergence portion.

More generally, in other illustrative examples the beam shaping element may be used to tailor the intensity profile of the optical beam so that it has any desired shape when incident on the target. For instance, the beam shaping element may adjust the intensity profile so that the beam that is incident upon the center of the target will have a first beam portion with a maximum intensity and a second, less intense beam portion which is asymmetrically distributed about the target's center. In this way a detector may be located on any convenient part of the target by directing the second portion of the beam to the detector when the first portion of the beam strikes the center of the target.

DETAILED DESCRIPTION

Figure 1:
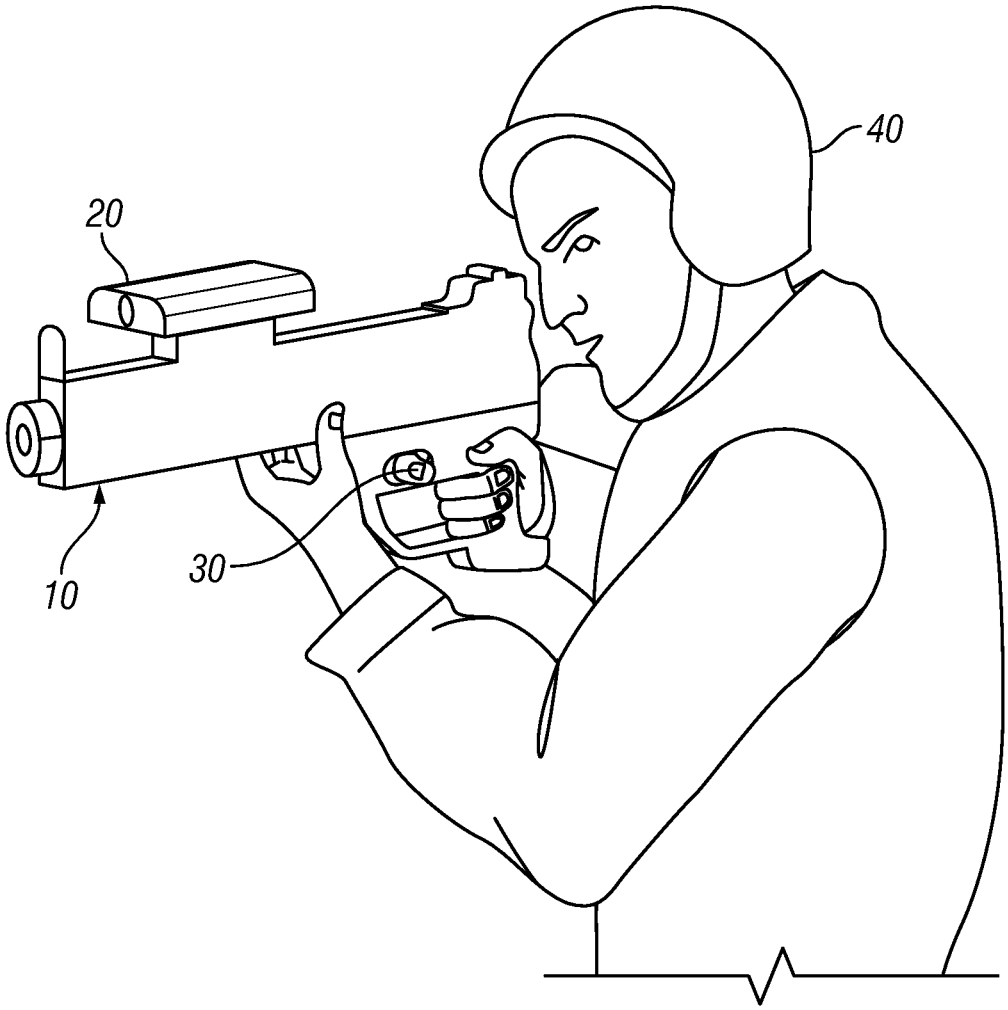
FIG. 1 is a perspective view of a participant using a weapon firing simulation system who is equipped with a weapon.

FIG. 1 is a perspective view of a participant using a weapon firing simulation system who is equipped with a weapon. The weapon may be any suitable firearm that is constructed for the purpose of performing simulations or is retrofitted for this purpose. The weapon has a firearm housing that can be aimed at a target using any suitable means such as a projection alignment marker extending from the housing, an optical viewfinder, or the like. The weapon 10 includes an optical transmitter 20, which in one implementation is attached to the barrel of the weapon by any suitable means. The transmitter 20 includes an optical source such as a laser or diode. The optical source generates a beam of energy at one or more optical wavelengths, which includes both visible wavelengths and non-visible wavelengths such as infrared and ultraviolet wavelengths. The transmitter 20 is mechanically and operationally connected to the weapon in such a manner that it can detect when the trigger is depressed and emit an optical beam in response thereto.

In some implementations the transmitter 20 may modulate the optical beam to encode it with information that can be extracted by a detector located on the target. For instance, the optical beam may be pulse code modulated to include information such as the type of weapon and ammunition that is being simulated, an identifier of the gunner and a time at which the weapon was fired.

A weapon firing simulation for close combat (e.g., 1-4 meters) presents a problem because the optical beam size generated by the optical transmitter is necessarily narrow or small as it leaves the transmitter. The amount by which the size of an optical beam increases is determined by its divergence, which is the angular measure of the increase in beam diameter with increasing distance from the source. While all optical beams undergo divergence, the value of the divergence can vary for different types of beams. Because of divergence, at long ranges, where the source to target distance is large, the beam size may have sufficiently expanded to allow the beam to be easily detected by a single detector located on the target, regardless of where on the target the beam center actually hits. On the other hand, the size of a beam that reaches a target at close range is relatively small. A beam with such a small size may accurately represent or simulate a projectile fired at close range since the projectile would strike the target at the same location as the optical beam, but it also causes certain problems.

One problem caused by a small beam size is that the beam may hit the target, yet miss one of the detectors located on the target. One way to address the problem caused by a small beam size is to increase the divergence of the beam with an optical arrangement so that the beam size is large even at relatively small distances between the weapon and the target. But this causes other problems at longer ranges because the even larger beam sizes that result at such ranges prevents the beam from accurately representing a realistic projectile, thereby making the target unrealistically easy to hit. Another way to address this issue is to leave the beam size small and place a greater number of detectors on the target so that the likelihood of missing one of them is small. But this approach can decrease the overall reliability of the system and may be cumbersome to implement, particularly when the target is a person because it can restrict the person's ability to move and react in the same way as he or she could without the encumbrance.

In many cases it would be desirable to place only a single detector on the person who is the target. For instance, one place to locate the detector so that it reduces interference to the person wearing it is on the person's head. In addition to the problems noted above, another problem that arises if a single detector is located on the head is that a gunner is typically taught to aim at the target's center of mass, which in the case of person is the chest area. Thus, a detector located on the head should be able to receive optical energy from a transmitter aimed at the body. As will be illustrated with reference to FIG. 2, this makes the small beam size resulting from close weapon firing even more of a problem.

The aforementioned problems are overcome by the optical transmitter described below.

Figure 2:
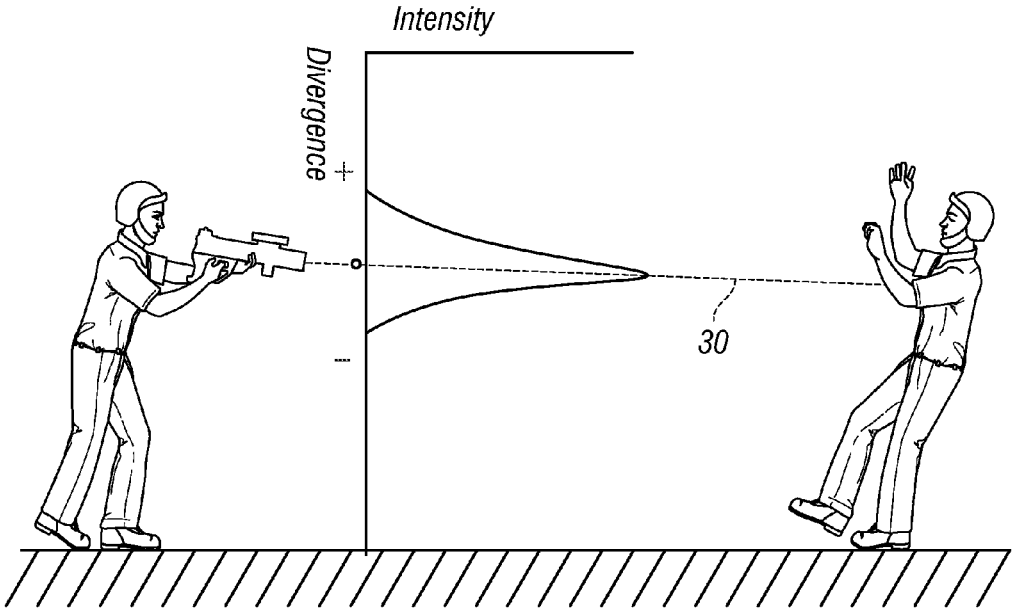
FIG. 2 shows a gunner aiming a weapon at a person acting as a target along with a graph of the intensity profile along the target of the optical beam produced by the weapon.

FIG. 2 shows a gunner aiming a weapon at a person acting as a target. The weapon is part of a weapon simulation system that emits an optical beam in the direction along which the gunner aims. In this example the gunner is in close range to the target and aiming at the target's chest. The solid line in the graph to the right of the target shows the intensity profile of the optical beam when it strikes the target. The abscissa of the graph represents the intensity of the beam and the ordinate represents the distance along a line perpendicular to the axis along which the gunner is aiming (i.e., the distance along the target). Thus, a line parallel 30 to the abscissa and extending through the origin of the ordinate represents the actual axis along which the gunner aims. The irradiance or intensity profile in FIG. 2 is representative of a laser beam, which is typically Gaussian in shape, i.e., the beam intensity in a plane normal to the beam path is a maximum at the center or beam waist point and decreases as the distance from the center point increases. As FIG. 2 illustrates, the beam size at close range is relatively small, and thus the majority of the optical energy aimed at the chest strikes the target on or near the chest, with little to no energy striking the head.

Figure 3:
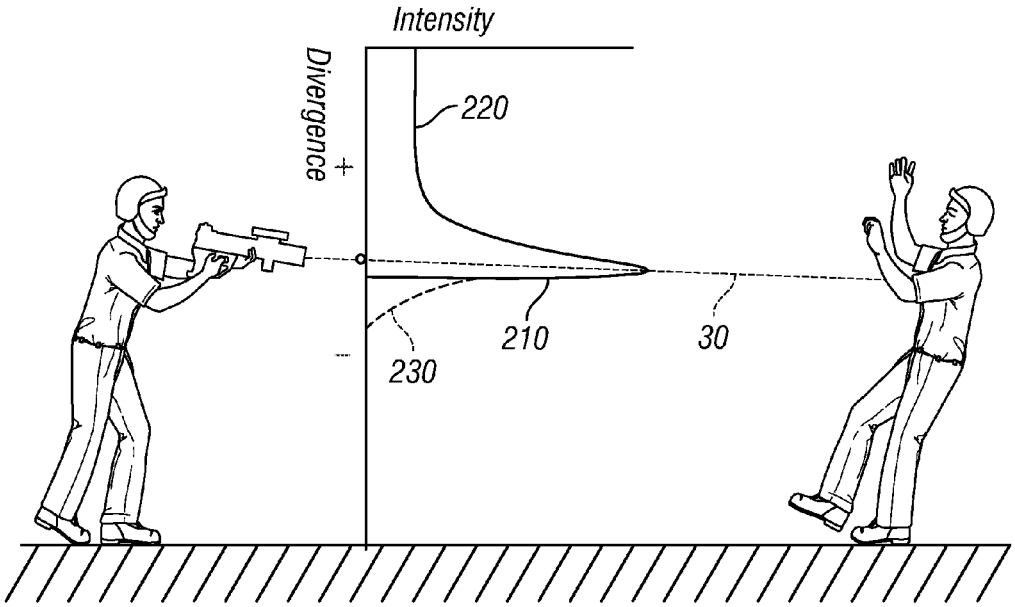
FIG. 3 is similar to FIG. 2 except that in FIG. 3 the intensity profile is now asymmetric about the axis along which the gunner is aiming so that a portion of the optical beam is re-directed upward and incident upon the head.

Because of the shape of the intensity profile shown in FIG. 2, an optical detector located on the head of the target clearly will not detect optical energy from a transmitter aimed at the body. In principle, the intensity profile shown in FIG. 2 could be modified in a number of different ways to allow a head-mounted detector to detect an optical beam aimed at the chest. One example of such a profile is shown in FIG. 3. As shown, the intensity profile is now asymmetric about the axis 30 along which the gunner is aiming. In particular, a portion of the optical energy from the primary beam (i.e., the beam shown in FIG. 2) is re-directed upward so that it diverges toward the head. In FIG. 3 the primary beam portion is denoted by reference numeral 210 and the re-directed, highly divergent portion, referred to herein as the secondary beam portion, is denoted by reference numeral 220. In the example shown in FIG. 3 the primary beam portion 210 has a relatively small divergence of about 6 milliradians whereas the secondary beam portion 220 shown in FIG. 3 diverges by upwards of about 15 degrees or more.

In some implementations the energy that is removed from the primary beam portion and transferred or otherwise re-directed into the secondary beam portion 220 is taken from the portion of the primary beam that is diverging downward (i.e., the portion of the primary beam 210 diverging at negative angles of divergence in FIG. 2), away from the target's head. In FIG. 3 this missing portion of the primary beam is denoted by dashed line 230. In other implementations, the energy in the secondary beam portion 220 may be extracted from any portion of the primary beam 210 such as the centermost portion.

Figure 4:
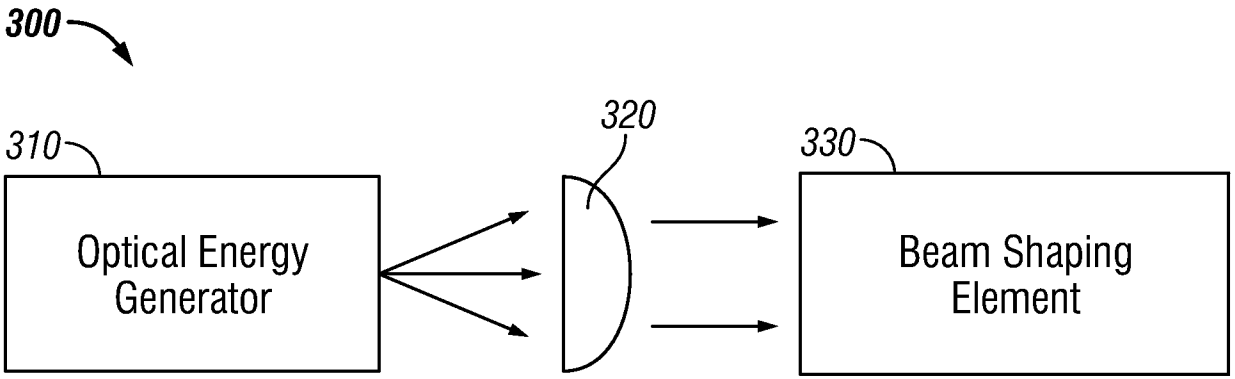
FIG. 4 is a schematic diagram of one example of the laser source employed in the optical transmitter used in the weapon.

A schematic diagram of one example of the laser source 300 employed in optical transmitter 20 is shown in FIG. 4. The laser source 300 includes an optical energy generator 310, collimator 320 and beam shaping element 330. The optical energy generator 310 may by any appropriate element that generates optical energy such as a semiconductor LED or laser package. In one example, a semiconductor laser may be employed such as a cw (continuous wave) laser operating at a wavelength between about 880 nanometers nm and 10 microns. In one particular example the laser may be centered at about 904 nanometers and extend from about 880 nanometers to about 950 nanometers. The output power of the laser may be, for example, about 0.6 ergs per pulse or less. Of course, lasers operating at other optical wavelengths and output powers may be used as well. For instance, an optical wavelength of 1550 nanometers may be well-suited for certain applications since it has been found to be safe if aimed at the eyes. The collimator 320 may be any optical element or elements such as a convex lens which collimates the optical beam received from the optical energy generator 310.

The beam shaping element 330 takes an input optical beam and generates an output optical beam that is the Fourier transform of the optical field of input beam and a phase function. In principle a beam shaping element can take an input beam having any particular intensity profile and produce an output laser beam having any other intensity profile that is desired. For instance, the beam shaping element 330 can take the Gaussian intensity profile shown in FIG. 2 and produce the asymmetric intensity profile shown in FIG. 3, which has a primary beam that is largely Gaussian in shape and a secondary beam that is highly divergent. In this way the beam shaping element 330 can adjust the intensity profile of the optical beam. It should be noted that in some implementations the collimator 320 may be a part of the beam shaping element 330, or, in some cases, eliminated entirely.

Figure 5:
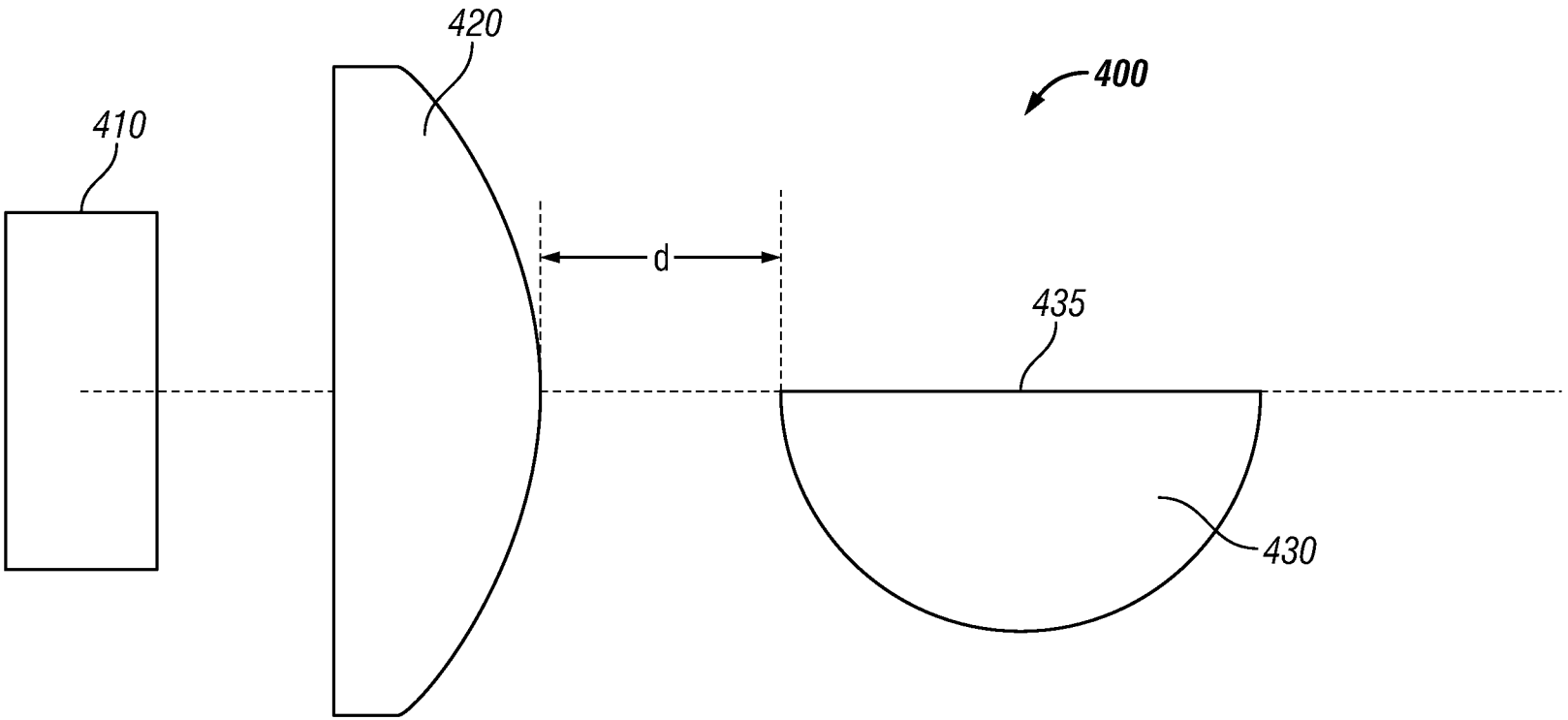
FIG. 5 shows one particular implementation of the laser source shown in FIG. 4, which includes an optical energy generator, a collimator and a beam shaping element formed from a half-cylinder.

FIG. 5 shows one example a laser source 400 that includes optical energy generator 410, collimator 420 and a beam shaping element formed from a half-cylinder 430. The half-cylinder 430 has a planar surface 435 along the cylinder's diameter, which as shown is aligned with the optical axis of the collimator 420.

Figure 6A:
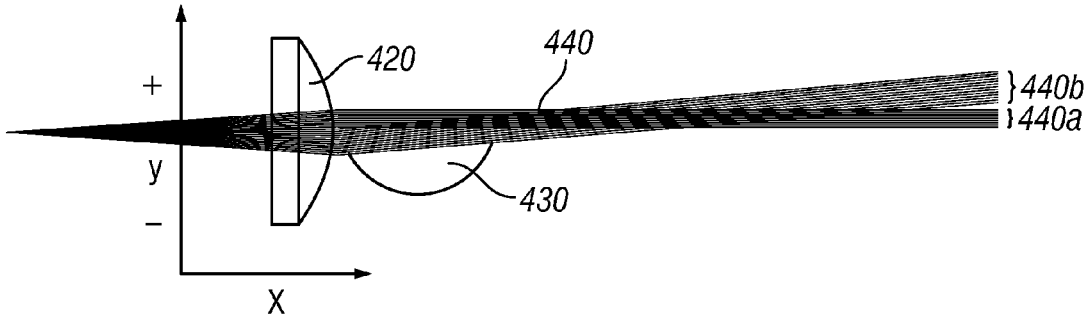
FIG. 6*a* shows an optical beam being processed by the collimator and beam shaping element of FIG. 5
Figure 6B:
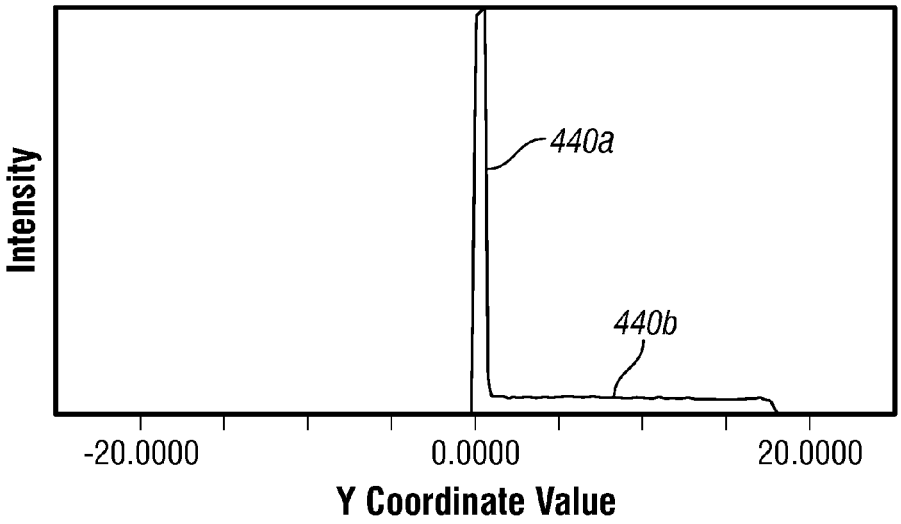
FIG. 6*b* shows the corresponding intensity profile of the optical beam that is output from the beam shaping element.

Referring now to FIG. 6*a*, the half-cylinder 430 receives a portion of the optical beam from the collimator 420 while another portion does not traverse the half cylinder 430. As FIG. 6*a* shows, the resulting output beam 440 directed toward the target has the intensity profile illustrated in FIG. 3. That is, the output beam includes a primary beam portion 440*a* and a more highly divergent secondary beam portion 440*b*. FIG. 6*b* shows the intensity profile of the optical output beam 440 shown in FIG. 6*a*, where the ordinate represents intensity and the abscissa represents the divergence away from the optical axis of the collimator 420. In this example the majority of the energy is allocated to the primary beam 440*a* and the remaining energy is allocated to the secondary beam 440*b*. The secondary beam 440*b* diverges by over 15 degrees in this example. The primary beam 440*a*, which remains aligned with the optical axis of the laser source (and hence the optical axis of the firearm), simulates the trajectory of a projectile fired at close range. The secondary beam 440*b* may be directed to a detector located on the target. It should be noted that the secondary beam only diverges in a direction along one side of the optical axis but not the other side. For instance, in FIG. 6*b* the secondary beam diverges in a direction corresponding to positive angles of divergence but not negative angles of divergence.

Figure 7A:
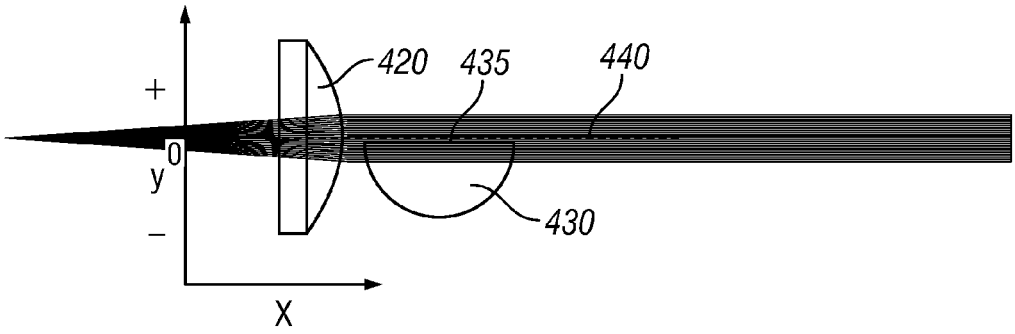
FIGS. 7*a* and 7*b* are similar to FIGS. 6*a* and 6*b*, respectively, except that in FIGS. 7*a* and 7*b* the planar surface is below the optical axis of the collimator.
Figure 7B:
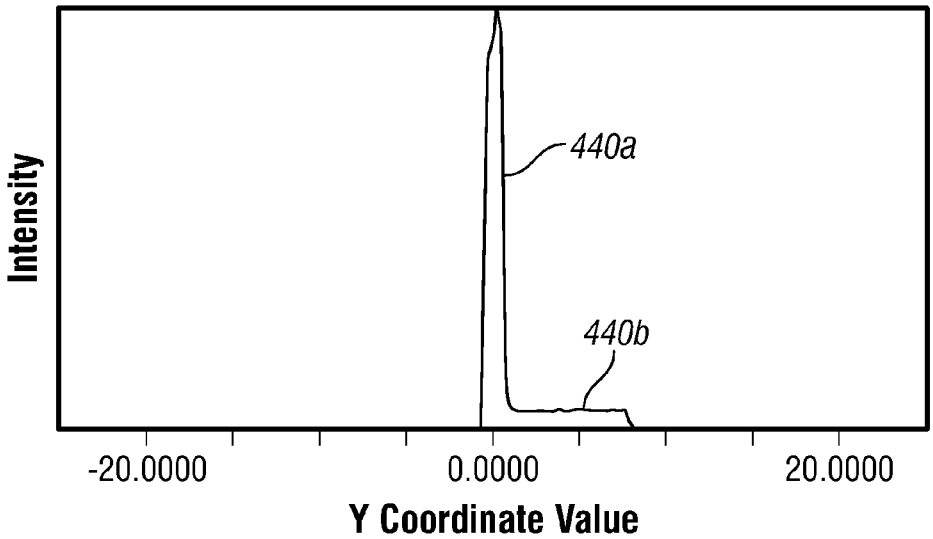

The amount of energy that is allocated to the secondary beam 440*b* and the degree to which it diverges are both adjustable design parameters determined by the position and orientation of the half-cylinder 430 with respect to the collimator 420. For instance, if the planar surface 435 of the half cylinder 430 is moved downward, away from the optical axis of the collimator 420 while remaining parallel to the optical axis, the amount of energy directed into the secondary beam 440*b* is reduced and its divergence is reduced. This can be seen in FIGS. 7*a* and 7*b*, which are similar to FIGS. 6*a* and 6*b*, respectively, except that in FIGS. 7*a* and 7*b* the planar surface 435 is below the optical axis of the collimator 420. As the figures show, the total amount of energy in the secondary beam 440*b* has been reduced in comparison to FIGS. 6*a* and 6*b* and the divergence has been reduced to below 15 degrees. In some cases it will generally be desirable to maintain most of the optical energy in the primary beam portion with, in one example, about 40% or less of the optical energy being contained in the secondary beam.

Figure 8:
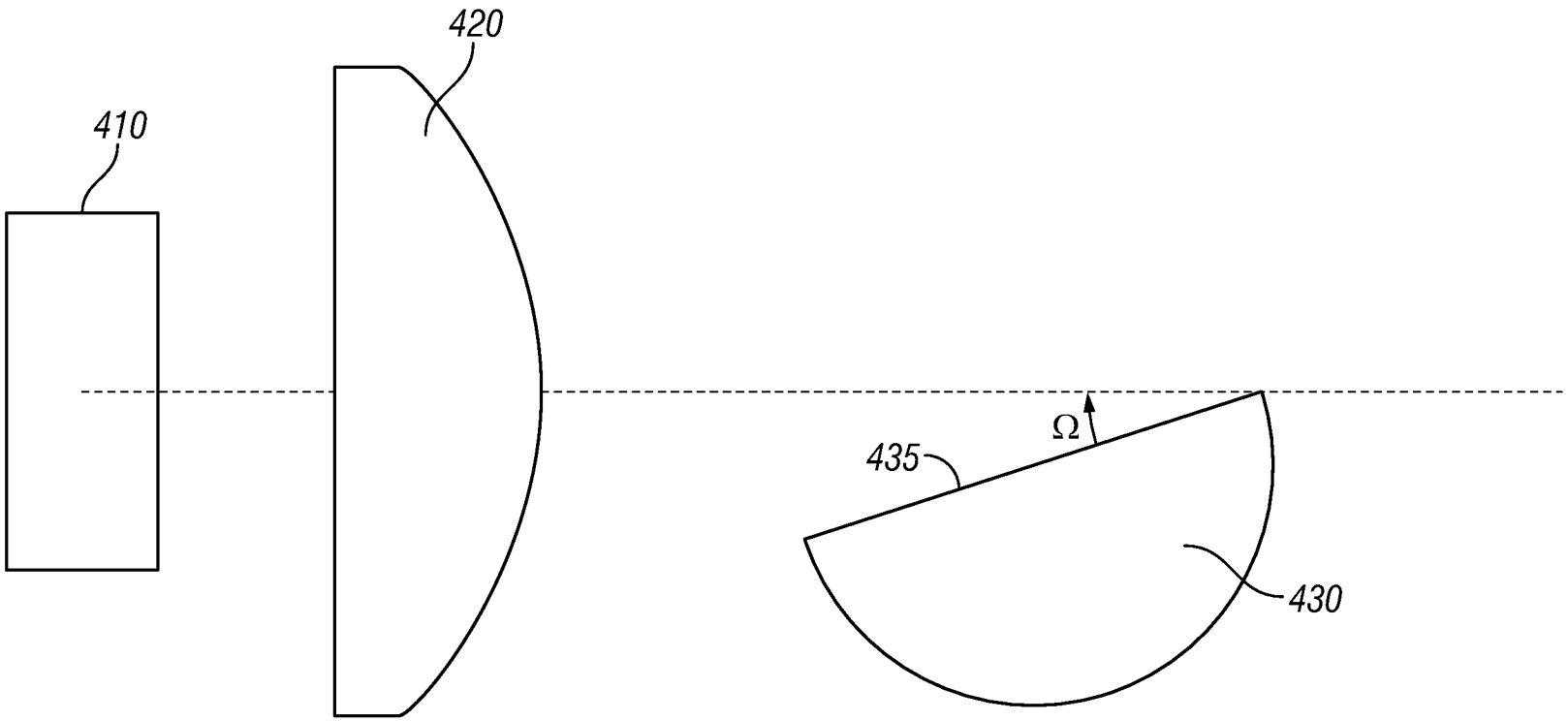
FIG. 8 shows an implementation of the laser source similar to that shown in FIG. 5 except that in FIG. 8 the planar surface of the half-cylinder is arranged so that it is non-parallel to the optical axis of the collimator.

Another design parameter that may be adjusted is the distance d between the collimator 420 and the half-cylinder 430 (see FIG. 5). As the distance d increases, the amount of energy in the secondary beam goes down without causing a significant change in its divergence. In addition, if as is shown in FIG. 8, the planar surface 435 of the half-cylinder is arranged so that it is non-parallel to the optical axis of the collimator 420, the divergence of the secondary beam goes down.

Figure 9A:
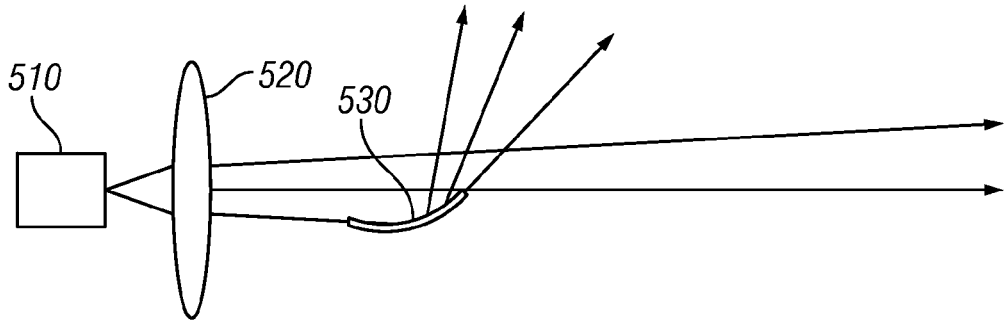
FIGS. 9*a* and 9*b* show a laser source that includes a collimator and a concave mirror surface and a convex mirror surface, respectively.
Figure 9B:
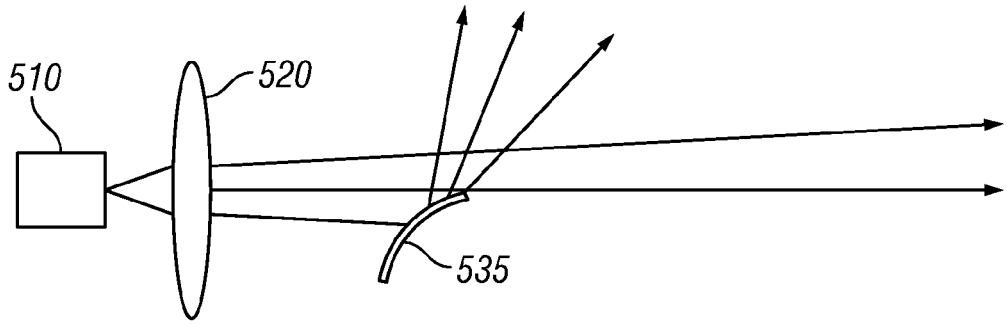

It should be emphasized that the half-cylinder 430 discussed above is only one example of a beam shaping element 330 and that many alternative implementations are possible. For example, the half-cylinder may be replaced with a mirror to achieve similar results. FIGS. 9*a* and 9*b* show a laser source that includes an optical energy generator 510, a collimator 520 and a concave mirror surface 530 and convex mirror surface 535, respectively. Of course, more complex arrangements may be employed that incorporate multiple refractive and/or reflective optical elements. In addition to such implementations, in other implementations the beam shaping element 330 may include diffractive optical elements such as gratings and holographic optical elements (HOEs). An HOE is an optical component used to modify light rays by diffraction, and is produced by recording an interference pattern of two laser beams and can be used in place of lenses or prisms where diffraction rather than refraction is desired. An HOE can be used to replace any number of optical elements, such as refractive elements (e.g., lenses), beamsplitters, and diffraction gratings, or even a simple mirror. HOEs have a number of advantages, including a simple design, small size, low weight and low cost. In yet other implementations, the beam shaping element may be a spatial light modulator, which consists of an array of optical elements in which each element acts independently as an optical "valve" to adjust or modulate light intensity. Examples of technologies that have been used as spatial modulators include liquid crystal devices or displays (LCDs), acousto-optical modulators, micromirror arrays such as micro-electro-mechanical (MEMs) devices and grating light valve (GLV) devices.

In some implementations the beam shaping element may be dynamically adjustable so that the intensity profile of the input optical beam can be automatically adjusted in response to a control signal. That is, the characteristics (e.g., the total energy and divergence) of the secondary beam can be adjusted in response to the signal from a controller. In this way the intensity profile can be adjusted to accommodate different types of battlefield scenarios. For instance, the intensity profile can be adjusted to simulate the ballistic characteristics of different types of weapons and/or ammunition. The manner in which the beam shaping element is adjusted will depend on the nature of the beam shaping element. For instance, if the beam shaping element is a half-cylinder, a motor may be employed to vary the angle Ω between the planar surface 435 of the half cylinder and the optical axis of the collimator shown in FIG. 8. In this way the divergence of the secondary beam can be controllably adjusted. On the other hand, if the beam shaping element is an HOE, a controller can adjust its configuration (i.e., its diffraction pattern), which in turn adjusts the intensity profile of the optical output beam.

Figure 10:
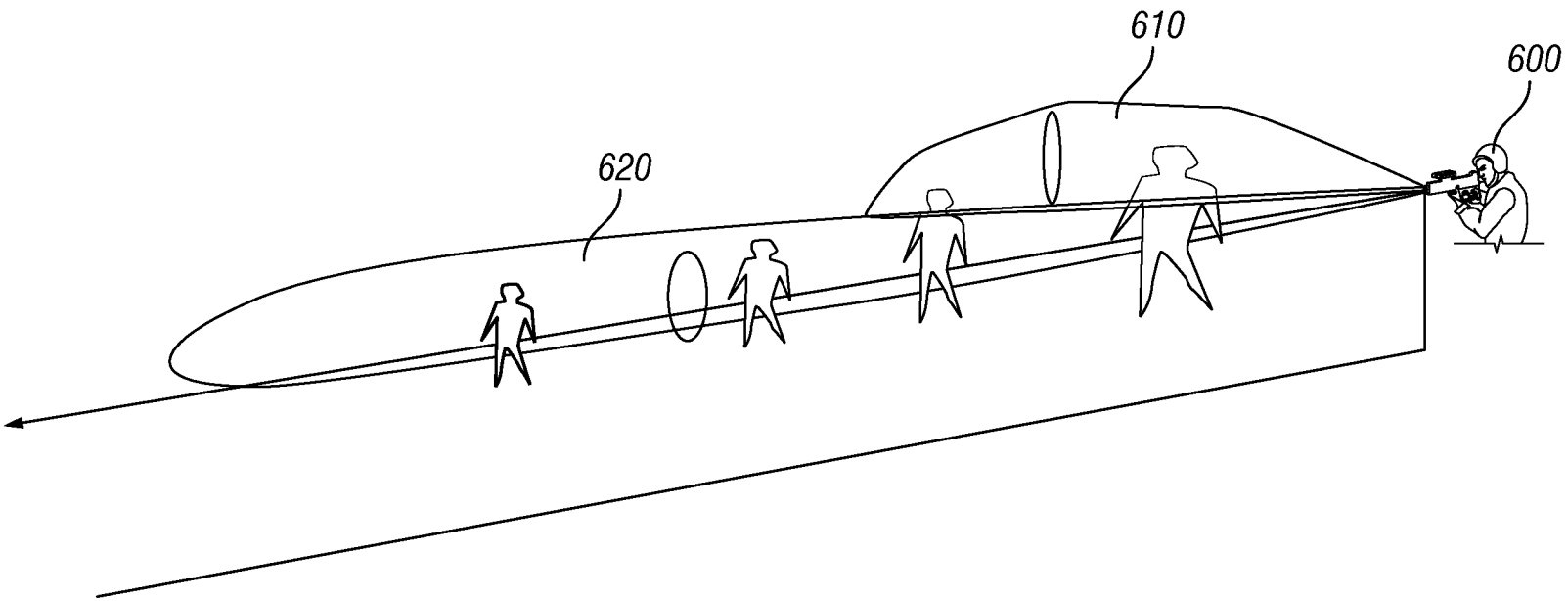
FIG. 10 shows a perspective view of a gunner firing a weapon that generates an optical beam with the intensity profile shown in FIG. 3 for a sequence of targets located at successively greater distances from one another.

One important advantage that arises from the use of an optical transmitter that produces the intensity profile shown in FIG. 3 is that it can be used to simulate both close combat and long range combat. At close ranges the secondary beam will have sufficient energy and diverge by a sufficient amount so that it is detected by a detector on the head of the target even if the weapon is aimed at the chest. At long distances the primary beam, which will typically contain the majority of the optical energy, will have sufficient energy and, given the longer distance, will able to diverge by a sufficient amount to also be detected by a detector on the head of a person representing the target even if the weapon is aimed at the chest. This feature is illustrated in FIG. 10, which shows the effective beam profile generated by an optical source 600 as it is incident upon a sequence of targets located at successively greater distances from one another. The beam portion 610 has a relatively large divergence and a larger extinction, thus it does not travel very far. The beam portion 620 has a relatively small divergence and a smaller extinction, thus it travels further than beam portion 610. More generally, an intensity profile can be selected so that when the weapon or firearm is aimed at the target's center of mass, the secondary beam portion will be incident upon any other desired portion of the target.

Figure 11:
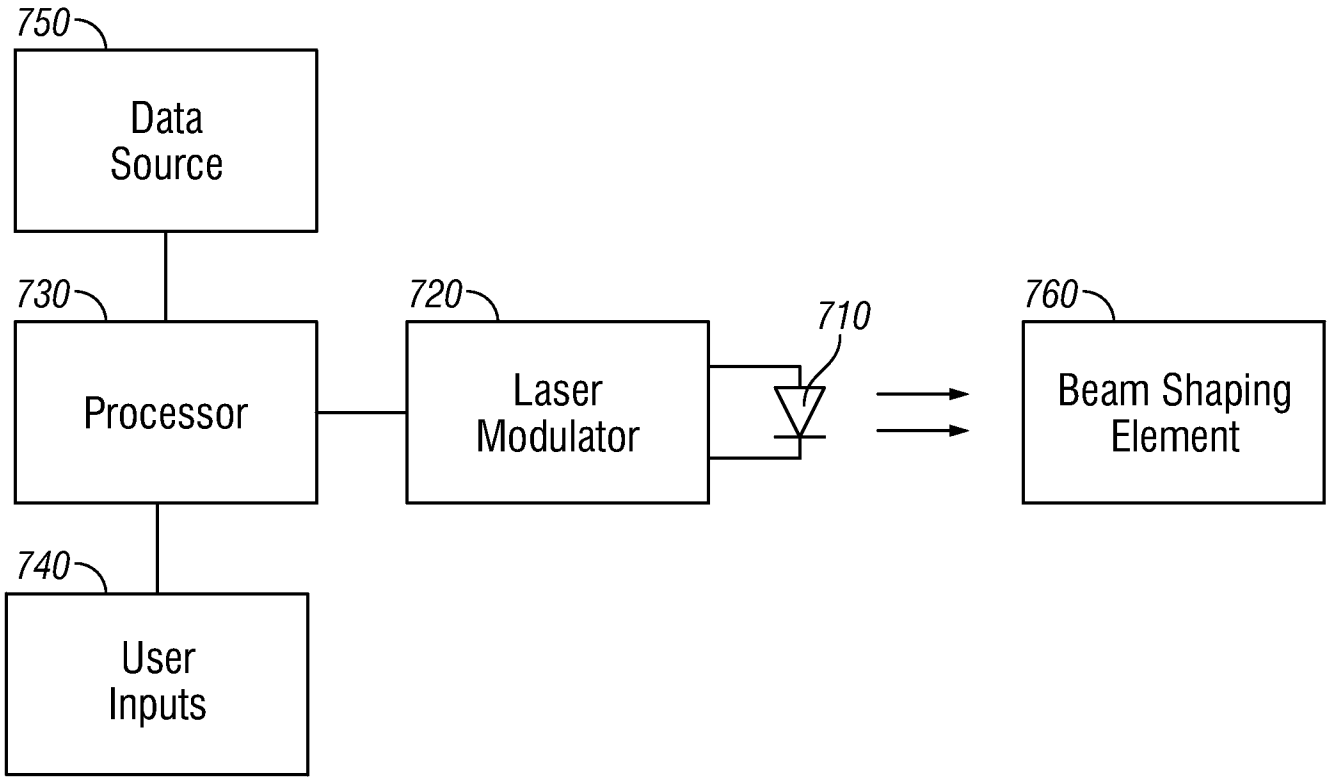
FIG. 11 shows a schematic block diagram of the electronics associated with one example of the optical transmitter shown in FIG. 1.

FIG. 11 shows a schematic block diagram of the electronics associated with one example of the optical transmitter 20. In this example a semiconductor laser 710 is driven by a laser modulator 720, which in turn operates under the control of a processor 730. In those implementations where the beam shaping element 760 is dynamically adjustable, the processor 730 also generates a control signal that reconfigures the beam shaping element 760 so that it produces the desired intensity profile. A user input 740 sends control signals to the processor 730 in response to actions performed by the user. Such user action may include, for instance, a trigger pull which generates a control signal that causes the laser to generate the laser beam. Other types of user action may specify, for instance, the weapon and ammunition type, a user ID, a time of day, and so on. Some of these user inputs will be used as data that is modulated onto the optical beam, while other data, such as the weapon and ammunition may in addition (or instead) be used to reconfigure the beam shaping element so that the optical beam that is generated properly simulates a projectile of the type that the user specifies. A data source 750 such as a computer readable storage medium may be provided which contains other information that is not user-adjustable and which may be modulated onto the optical beam.

Those skilled in the art will recognize that, for simplicity and clarity, the full structure and operation of the optical transmitter 20 is not being depicted or described herein. Instead, only so much of the transmitter is described as needed to facilitate an understanding of the systems and methods being depicted and described herein. The remainder of the construction and operation of the optical transmitter may conform to any of the various implementations and practices known in the art. Moreover, it is contemplated that the components shown in FIG. 11 may each be implemented in hardware, software, firmware or a combination thereof. In addition, although the various components are shown as separate components, it is contemplated that their functionality may be combined in fewer components or even divided into additional components.

The processor 730 may execute instructions, either at the assembly, compiled or machine-level, to perform that process. Those instructions can be written by one of ordinary skill in the art and stored or transmitted on a computer readable storage medium. The instructions may also be created using source code or any other known computer-aided design tool. A computer readable storage medium may be any medium capable of carrying those instructions and include a CD-ROM, DVD, magnetic or other optical disc, tape or silicon memory (e.g., removable, non-removable, volatile or non-volatile).

Figure 12:
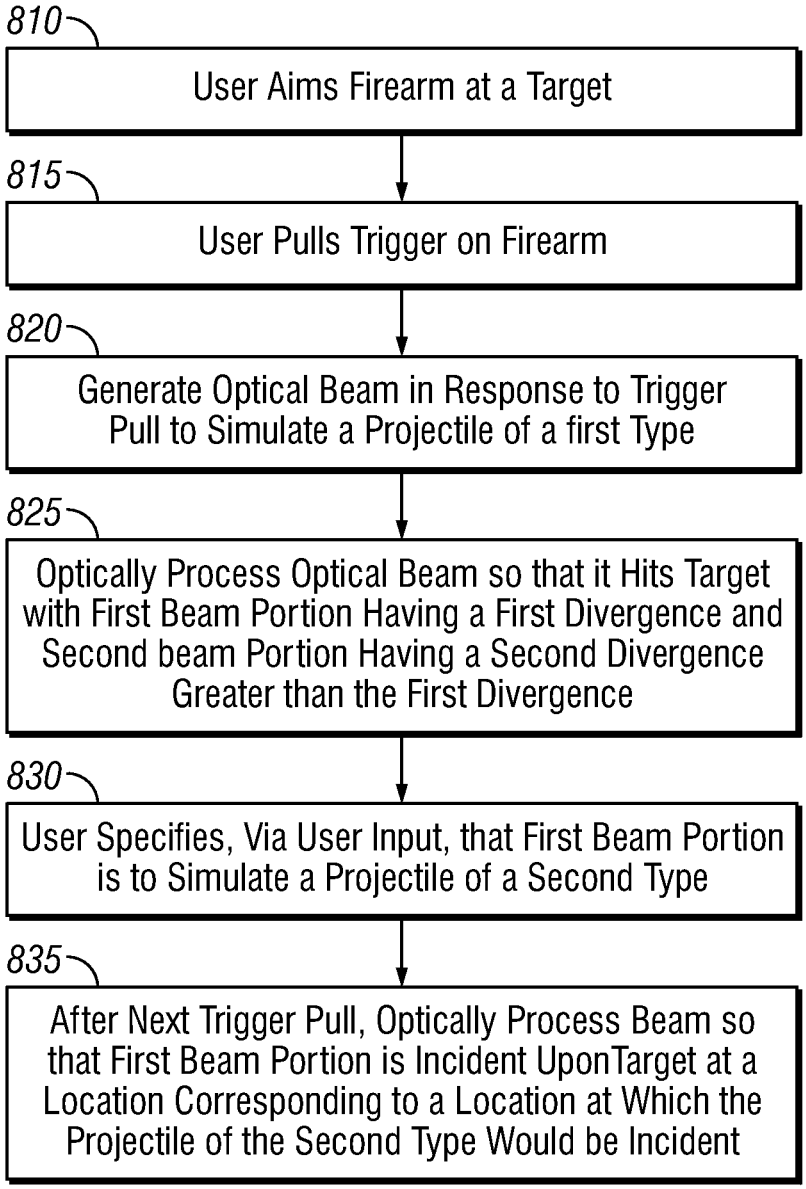
FIG. 12 is a flowchart illustrating one example of a method for simulating a close combat conflict.

FIG. 12 is a flowchart illustrating one example of a method for simulating a close combat conflict. The method begins in step 810 when a user aims a firearm at a target. The user pulls the trigger on the firearm in step 815. In response to the trigger pull, the firearm generates an optical beam in step 820. The optical beam is intended to simulate a projectile of a first type. The optical beam is optically processed in step 825 by, e.g., beam shaping, so that it hits the target with a first beam portion having a first divergence and a second beam portion having a second divergence greater than the first divergence. In this way the first beam portion is incident upon the target at a location that corresponds to a location at a projectile of the first type would be located. The second beam portion is incident upon another location on the target where a detector may be located.

The user now decides to simulate the firing of ammunition of a second type instead of the first type. Accordingly, in step 830 the user specifies, via the firearm's user interface, that the first beam portion is to simulate a projectile of the second type. In this way, after the next trigger pull, the optical beam is optically processed in step 835 so that the first beam portion is incident upon the target at a location that corresponds to a location at which a projectile of the second type would be incident.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A simulated weapon comprising:

a firearm housing configured to facilitate being aimed at a target by a gunner;

an optical transmitter mechanically coupled to the firearm housing for transmitting an optical beam that simulates a projectile, said optical transmitter including;

an optical generator for generating the optical beam; and a beam shaping element operatively positioned to receive a portion of the optical beam from the optical generator, said beam shaping element being configured to adjust an intensity profile of the optical beam that is incident upon the target so that a first portion of the optical beam bypasses the beam shaping element to simulate a trajectory of a projectile and a second portion of the optical beam is re-directed by the beam shaping element to have a greater divergence than the first portion of the optical beam.

2. The simulated weapon of claim 1 wherein the intensity profile of the optical beam is asymmetric about an axis along which the firearm housing is aimed such that its maximum intensity on the target is coincident with the first portion and the second portion is a reduced intensity beam portion which extends along the target on a single side of the axis.

3. The simulated weapon of claim 1 wherein the first portion of the optical beam contains a majority of its total energy.

4. The simulated weapon of claim 1 wherein the beam shaping element is configured to adjust the intensity profile that is incident upon a participant representing the target such that when the optical beam is aimed at a center of mass of the participant the secondary beam is incident upon a head of the participant.

5. The simulated weapon of claim 1 wherein the beam shaping element includes at least one refractive optical element, one reflective optical element, one diffractive optical element or a combination thereof.

6. The simulated weapon of claim 1 wherein the beam shaping element includes a collimating optical element having an optical axis and a half-cylinder lens positioned to receive at least a portion of a collimated optical beam from the collimating element, said half-cylinder lens having a planar surface below and parallel to the optical axis.

7. The simulated weapon of claim 1 wherein the beam shaping element is a dynamic beam shaping element for dynamically adjusting the intensity profile of the optical beam in response to a control signal.

8. The simulated weapon of claim 7 further comprising a user interface for receiving user-selectable parameters that at least in part causes the dynamic beam shaping element to adjust the intensity profile so that it changes shape.

9. A method for simulating firing a projectile comprising:

generating an optical beam in response to a user input, said optical beam having an optical axis extending to a target; and utilizing a beam shaping element operatively positioned to receive a portion of the optical beam to adjust an intensity profile of the optical beam so that a first portion of the optical beam bypasses the beam shaping element to be incident upon the target with a maximum intensity portion that intersects a first location on the target along the optical axis to simulate a trajectory of said projectile and a second portion of the optical beam is re-directed by interaction with the beam shaping element to have a greater divergence than the first portion of the optical beam.

10. The method of claim 9 wherein the second portion of the optical beam extends away from the optical axis for a first distance in a first direction along the target such that substantially no optical energy is present at the first distance in a second direction along the target that is opposite to the first direction.

11. The method of claim 10 wherein the second portion of the optical beam is substantially constant in intensity.

12. The method of claim 9 wherein the maximum intensity portion of the optical beam is substantially Gaussian in shape except for an absent portion of optical energy that was transferred from the second side of the optical axis to the reduced intensity portion on the first side of the optical axis.

13. The method of claim 9 wherein adjusting the intensity profile of the optical beam includes performing at least one process on the optical beam selected from the group consisting of refraction, reflection or diffraction.

14. The method of claim 9 wherein adjusting the intensity profile includes dynamically adjusting the intensity profile in response to a control signal.

15. The method of claim 14 herein the control signal reflects user input specifying at least one parameter selected from the group consisting of a weapon type and an ammunition type.

16. The method of claim 15 wherein the user input is a trigger pull on a firearm.

17. A method for simulating firing a projectile comprising:

in response to a trigger pull on a firearm aimed at a target located a first distance away, generating an optical beam having an optical axis extending to the target; and optically processing the optical beam utilizing a beam shaping element operatively positioned to receive a portion of the optical beam to adjust an intensity profile of the optical beam so that a first portion of the optical beam bypasses the beam shaping element to be incident upon the target having a first divergence and a maximum intensity portion that intersects a first location on the target along the optical axis to simulate a trajectory of said projectile and a second portion of the optical beam is re-directed by interaction with the beam shaping element to have a second divergence greater than the first divergence portion.

18. The method of claim 17 wherein the second portion is located above the first portion when incident upon the target.

19. The method of claim 17 wherein the first portion is incident upon the target at a location that corresponds to a location at which would be incident by the projectile of a first type that is being simulated by the optical beam.

20. The method of claim 19 further comprising:

receiving user input specifying that the first portion is to simulate the projectile to be a second type; and in response to the user input, optically processing the optical beam so that the first portion which is being simulated by the optical beam is incident upon the target at a location that corresponds to a location at which the projectile of the second type would be incident.

* * * * *